US010179452B2

(12) United States Patent
Iwama et al.

(10) Patent No.: US 10,179,452 B2
(45) Date of Patent: Jan. 15, 2019

(54) LIQUID DISCHARGE HEAD, LIQUID DISCHARGE DEVICE, AND LIQUID DISCHARGE APPARATUS

(71) Applicants: Masami Iwama, Ibaraki (JP); Yukio Otome, Ibaraki (JP); Takahiro Yoshida, Ibaraki (JP); Takakazu Kihira, Ibaraki (JP); Takayuki Nakai, Kanagawa (JP); Shiomi Andou, Kanagawa (JP); Isamu Suzuki, Kanagawa (JP); Ryuji Yoshida, Kanagawa (JP); Kanshi Abe, Ibaraki (JP); Junichi Iwata, Ibaraki (JP); Katsuya Ishii, Ibaraki (JP); Toshimichi Odaka, Kanagawa (JP)

(72) Inventors: Masami Iwama, Ibaraki (JP); Yukio Otome, Ibaraki (JP); Takahiro Yoshida, Ibaraki (JP); Takakazu Kihira, Ibaraki (JP); Takayuki Nakai, Kanagawa (JP); Shiomi Andou, Kanagawa (JP); Isamu Suzuki, Kanagawa (JP); Ryuji Yoshida, Kanagawa (JP); Kanshi Abe, Ibaraki (JP); Junichi Iwata, Ibaraki (JP); Katsuya Ishii, Ibaraki (JP); Toshimichi Odaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/844,831

(22) Filed: Dec. 18, 2017

(65) Prior Publication Data

US 2018/0194135 A1 Jul. 12, 2018

(30) Foreign Application Priority Data

Jan. 10, 2017 (JP) ..... 2017-002053
Nov. 6, 2017 (JP) ..... 2017-213790

(51) Int. Cl.
*B41J 2/175* (2006.01)
*B41J 2/14* (2006.01)
*B41J 2/17* (2006.01)

(52) U.S. Cl.
CPC ..... *B41J 2/14233* (2013.01); *B41J 2/14274* (2013.01); *B41J 2/1721* (2013.01);
(Continued)

(58) Field of Classification Search
CPC ..... B41J 2/14145; B41J 2/14233; B41J 2/14274; B41J 2/1721; B41J 2/17503;
(Continued)

(56) References Cited

U.S. PATENT DOCUMENTS

2013/0307911 A1* 11/2013 Hayashi ..... B41J 2/17563 347/93
2014/0218450 A1* 8/2014 Yoneta ..... B41J 2/17563 347/93

(Continued)

FOREIGN PATENT DOCUMENTS

JP 2014-043032 3/2014

*Primary Examiner* — Anh T. N. Vo
(74) *Attorney, Agent, or Firm* — Oblon, McClelland, Maier & Neustadt, L.L.P.

(57) ABSTRACT

A liquid discharge head includes a plurality of nozzles from which liquid is discharged, a plurality of individual-liquid-chambers communicating with the plurality of nozzles, respectively, a plurality of individual-drainage-channels communicating with the plurality of individual-liquid-chambers, respectively, a drainage-side common-liquid-chamber communicating with each of the plurality of individual-drainage-channels, a filter having filter holes and disposed between the plurality of individual-drainage-channels and the drainage-side common-liquid-chamber, and an intermediate-drainage-channel disposed between the filter and the plurality of individual-drainage-channels. The intermediate-drainage-channel faces the filter and communicates with two (Continued)

or more of the plurality of individual-drainage-channels. A cross-sectional area of the intermediate-drainage-channel is greater than a cross-sectional area of each of the plurality of individual-drainage-channels communicating with the intermediate-drainage-channel in a direction perpendicular to a direction of liquid flow.

11 Claims, 15 Drawing Sheets

(52) U.S. Cl.
CPC .. *B41J 2/17503* (2013.01); *B41J 2002/14258* (2013.01); *B41J 2002/14403* (2013.01); *B41J 2002/14467* (2013.01); *B41J 2202/12* (2013.01)

(58) Field of Classification Search
CPC ..... B41J 2/17563; B41J 2002/14258; B41J 2002/14467; B41J 2002/14403; B41J 2/01
See application file for complete search history.

(56) References Cited

U.S. PATENT DOCUMENTS

| | | | | |
|---|---|---|---|---|
| 2014/0253648 | A1* | 9/2014 | Yoneta | B41J 2/14274 347/93 |
| 2016/0297193 | A1 | 10/2016 | Yoshida | |
| 2017/0087865 | A1 | 3/2017 | Yoshida et al. | |
| 2017/0157924 | A1 | 6/2017 | Otome et al. | |
| 2017/0239949 | A1 | 8/2017 | Yoshida | |
| 2017/0253062 | A1 | 9/2017 | Murakami et al. | |
| 2017/0297333 | A1 | 10/2017 | Kohda et al. | |

* cited by examiner

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2017-002053, filed on Jan. 10, 2017 in the Japan Patent Office and Japanese Patent Application No. 2017-213790, filed on Nov. 6, 2017 in the Japan Patent Office, the entire disclosures of which are hereby incorporated by reference herein.

BACKGROUND

Technical Field

Aspects of the present disclosure relate to a liquid discharge head, a liquid discharge device, and a liquid discharge apparatus.

Related Art

As a liquid discharge head to discharge liquid, a circulation-type head is known in which liquid supplied to individual-liquid-chambers and not discharged from the nozzles is returned and circulated from a liquid drainage channel to a drainage-side common-liquid-chamber to enhance the ability to expel bubbles in the individual-liquid-chambers to maintain consistent liquid characteristics.

SUMMARY

In an aspect of this disclosure, a liquid discharge head includes a plurality of nozzles from which liquid is discharged, a plurality of individual-liquid-chambers communicating with the plurality of nozzles, respectively, a plurality of individual-drainage-channels communicating with the plurality of individual-liquid-chambers, respectively, a drainage-side common-liquid-chamber communicating with each of the plurality of individual-drainage-channels, a filter disposed between the plurality of individual-drainage-channels and the drainage-side common-liquid-chamber, and an intermediate-drainage-channel disposed between the filter and the plurality of individual-drainage-channels. The intermediate-drainage-channel faces the filter and communicates with two or more of the plurality of individual-drainage-channels. A cross-sectional area of the intermediate-drainage-channel is greater than a cross-sectional area of each of the plurality of individual-drainage-channels communicating with the intermediate-drainage-channel in a direction perpendicular to a direction of liquid flow.

In another aspect of this disclosure, a liquid discharge device includes the liquid discharge head as described above.

In still another aspect of this disclosure, a liquid discharge apparatus includes the liquid discharge device as described above.

In still another aspect of this disclosure, a liquid discharge head includes a plurality of nozzles from which liquid is discharged, a plurality of individual-liquid-chambers communicating with the plurality of nozzles, respectively, a plurality of individual-drainage-channels communicating with the plurality of individual-liquid-chambers, respectively, a drainage-side common-liquid-chamber communicating with each of the plurality of individual-drainage-channels, a filter disposed between the plurality of individual-drainage-channels and the drainage-side common-liquid-chamber, and an intermediate-drainage-channel disposed between the filter and the plurality of individual-drainage-channels, the intermediate-drainage-channel facing the filter and communicating with two or more of the plurality of individual-drainage-channels. A cross-sectional area of a boundary portion between the intermediate-drainage-channel and the filter is greater than a cross-sectional area of each of a boundary portion between the intermediate-drainage-channel and the plurality of the individual-drainage-channels communicating with the intermediate-drainage-channel.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
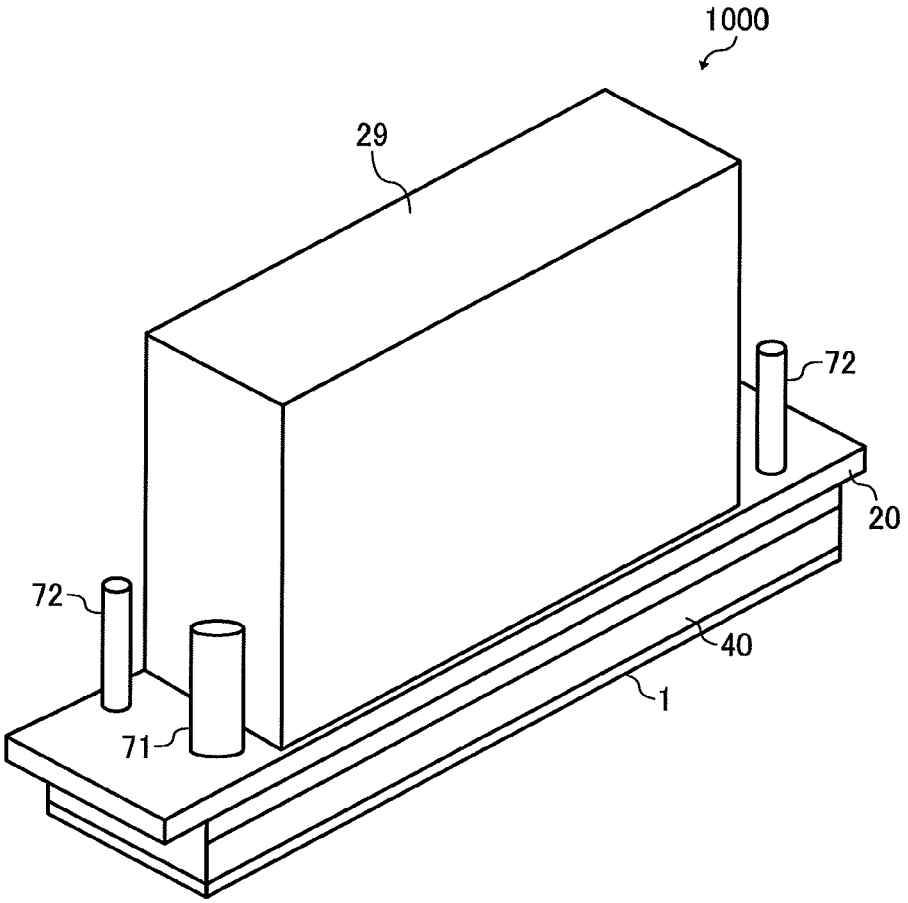
FIG. 1 is an external perspective view of a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Hereinafter, embodiments of the present disclosure are described with reference to the attached drawings. A liquid discharge head according to an embodiment of the present disclosure is described with reference to FIGS. 1 through 3.

FIG. 1 is an external perspective view of the liquid discharge head 1000.

Figure 2:
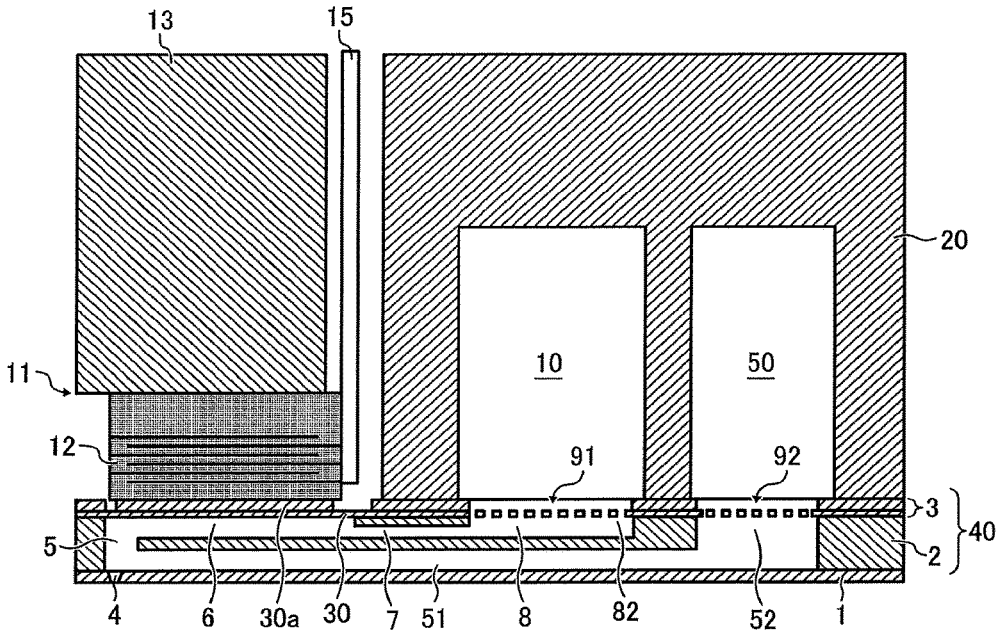
FIG. 2 is a cross-sectional view of the liquid discharge head in a direction perpendicular to a nozzle array direction (NAD) in which nozzles are arrayed in a row.

FIG. 2 is a cross-sectional view of the liquid discharge head 1000 in a direction perpendicular to a nozzle array direction (NAD) in which nozzles 4 are arrayed in a row (a longitudinal direction of an individual-liquid-chamber 6).

Figure 3:
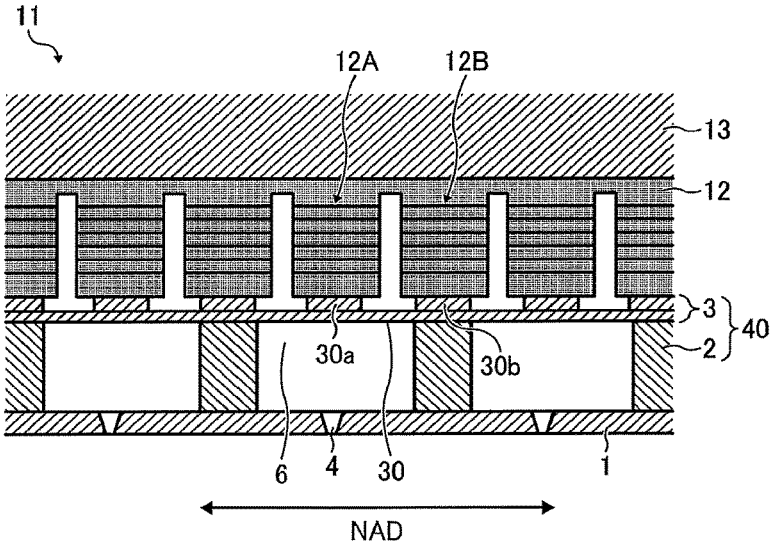
FIG. 3 is a cross-sectional view of the liquid discharge head in the nozzle array direction (NAD)

FIG. 3 is a cross-sectional view of the liquid discharge head 1000 in the nozzle array direction (NAD) as indicated by an arrow in FIG. 3.

A liquid discharge head 1000 includes a nozzle plate 1, a channel substrate 2, and a diaphragm member 3 that are laminated one on another and bonded to each other to form a wall of the individual-liquid-chambers 6. Hereinafter, the "liquid discharge head" is simply referred to as "head".

The head 1000 includes piezoelectric actuators 11 to displace a vibration portion (vibration plate) 30 of the diaphragm member 3, a common-liquid-chamber substrate 20 as a frame member of the head 1000, and a cover 29. The channel substrate 2 and the diaphragm member 3 constitute a channel member 40.

The nozzle plate 1 includes multiple nozzles 4 to discharge liquid.

The channel substrate 2 includes individual-liquid-chambers 6, supply-side fluid restrictors 7, individual-supply-channels 8, and intermediate-supply-channels 82. The individual-liquid-chambers 6 communicate with the nozzles 4 via the nozzle communication channel 5. The supply-side fluid restrictors 7 communicate with the individual-liquid-chambers 6. The individual-supply-channels 8 communicate with the supply-side fluid restrictors 7. The intermediate-supply-channels 82 communicate with two or more adjacent ones of the individual-supply-channels 8 in the nozzle array direction (NAD).

The diaphragm member 3 includes the deformable vibration portions 30 constituting a wall of the individual-liquid-chambers 6 of the channel substrate 2. In the present embodiment, the diaphragm member 3 has a two-layer structure including a first layer and a second layer. The first layer forms thin portions functions as the vibration portions 30 facing the channel substrate 2 and the individual-liquid-chambers 6. The second layer forms thick portions (convex portions 30*a* and 30*b*) to be connected to the piezoelectric elements 12. The first layer includes the deformable vibration portions 30 at positions corresponding to the individual-liquid-chambers 6. Note that the diaphragm member 3 is not limited to the two-layer structure and the number of layers may be any other suitable number.

The piezoelectric actuator 11 is disposed on the opposite side of the individual-liquid-chamber 6 of the diaphragm member 3, inboard of and away from the nozzles 4. The piezoelectric actuator 11 includes an electromechanical transducer element as a driver (e.g., actuator, pressure generator) to deform the vibration portions 30 of the diaphragm member 3. The piezoelectric actuator 11 includes piezoelectric elements 12 bonded on a base 13. The piezoelectric elements 12 are groove-processed by half-cut dicing so that each piezoelectric element 12 includes a desired number of pillar-shaped piezoelectric sub-elements 12A and 12B that are arranged in certain intervals in a comb shape.

The piezoelectric sub-elements 12A are joined to the convex portion 30*a*, which is a thick portion having an island-like form formed on the vibration portions (vibration plate) 30 of the diaphragm member 3. The piezoelectric sub-elements 12B are joined to the convex portion 30*b*, which is a thick portion of the diaphragm member 3.

The piezoelectric elements 12 are constructed of piezoelectric layers and internal electrodes alternately laminated. The internal electrodes are led out to an end face of the piezoelectric elements 12 to form external electrodes. The external electrodes are connected to a flexible wiring member 15.

The common-liquid-chamber substrate 20 includes a supply-side common-liquid-chamber 10 and a drainage-side common-liquid-chamber 50. The supply-side common-liquid-chamber 10 communicates with supply ports 71. The supply-side common-liquid-chamber 10 supplies liquid to the plurality of individual-liquid-chambers 6. The drainage-side common-liquid-chamber 50 communicates with the drainage ports 72 (See FIG. 1).

The channel substrate 2 includes individual-drainage-channels 51 and intermediate-drainage-channels 52. The individual-drainage-channels 51 are formed along a surface direction of the channel substrate 2 and communicate with the individual-liquid-chambers 6 via the nozzle communication channel 5. The intermediate-drainage-channels 52 communicate with two or more of the individual-drainage-channels 51 adjacent in the nozzle array direction (NAD).

Further, a supply-side filter 91 is disposed between the supply-side common-liquid-chamber 10 and the intermediate-supply-channels 82. A drainage-side filter 92 is disposed between the drainage-side common-liquid-chamber 50 and the intermediate-drainage-channels 52.

In the head 1000 thus configured, for example, when a voltage lower than a reference potential (intermediate potential) is applied to the piezoelectric sub-element 12A, the piezoelectric sub-element 12A contracts. Accordingly, the vibration portion 30 of the diaphragm member 3 is pulled inward to increase the volume of the individual-liquid-chamber 6, thus causing liquid to flow into the individual-liquid-chamber 6.

When the voltage applied to the piezoelectric sub-element 12A is raised, the piezoelectric sub-element 12A extends in a direction of lamination. Accordingly, the vibration portion 30 of the diaphragm member 3 deforms in a direction toward the nozzle 4 and the volume of the individual-liquid-chamber 6 contracts. Thus, liquid in the individual-liquid-chamber 6 is compressed and discharged from the nozzle 4.

Liquid not discharged from the nozzles 4 passes the nozzles 4 and is drained from the individual-drainage-channels 51 to the drainage-side common-liquid-chamber 50. Liquid is further supplied from the drainage-side common-liquid-chamber 50 to the supply-side common-liquid-chamber 10 again through an external circulation route.

Note that the driving method of the head 1000 is not limited to the above-described example (i.e., pull-push discharge). For example, pull discharge or push discharge may be performed in response to the way the drive wave is applied.

Next, a first embodiment of the present disclosure is described with reference to FIGS. 4 through 6.

Figure 4:
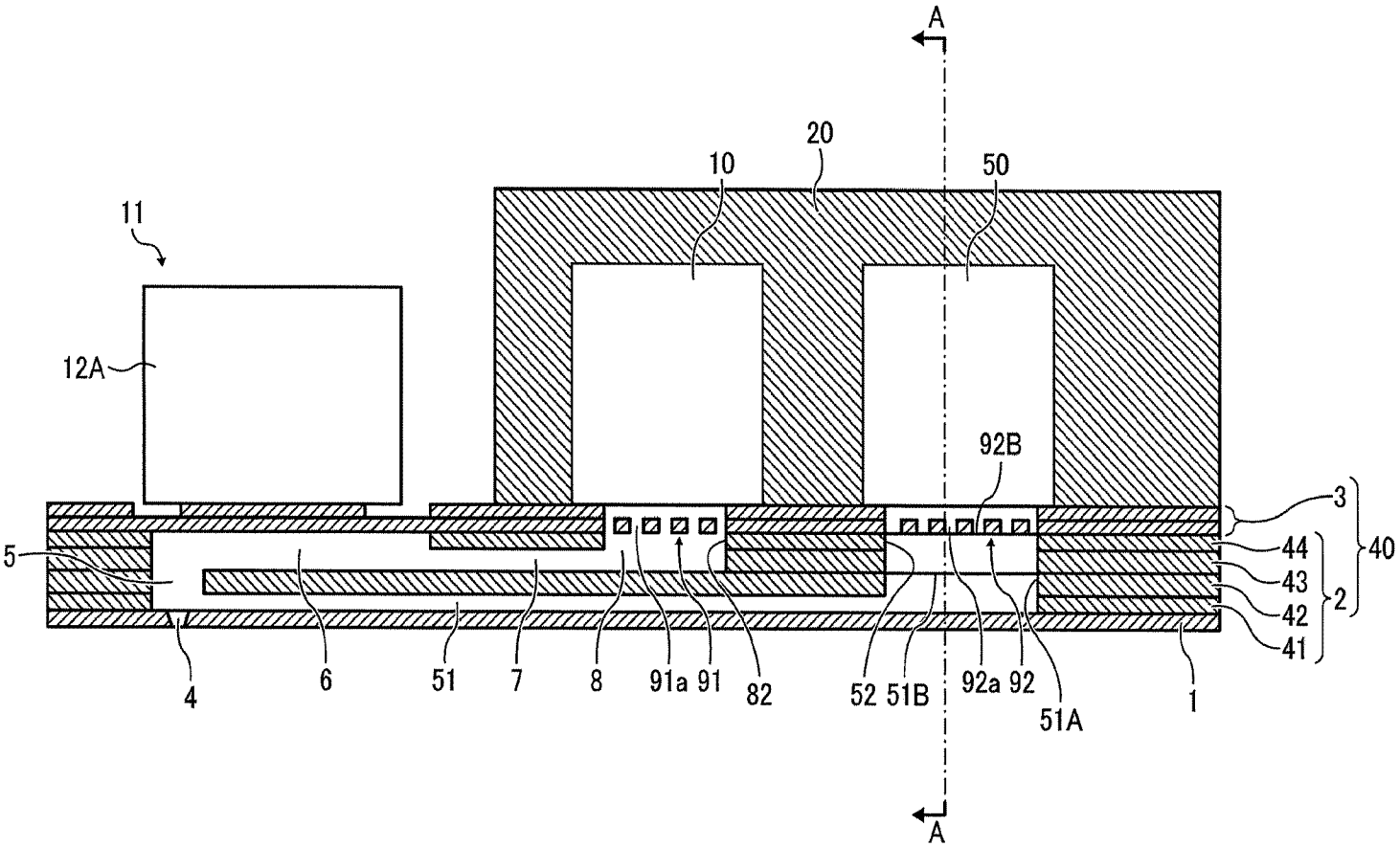
FIG. 4 is a cross-sectional view of the liquid discharge head in a direction perpendicular to the nozzle array direction (NAD) in a first embodiment of the present disclosure.

FIG. 4 is a cross-sectional view of the head 1000 in a direction perpendicular to the nozzle array direction (NAD).

Figure 5:
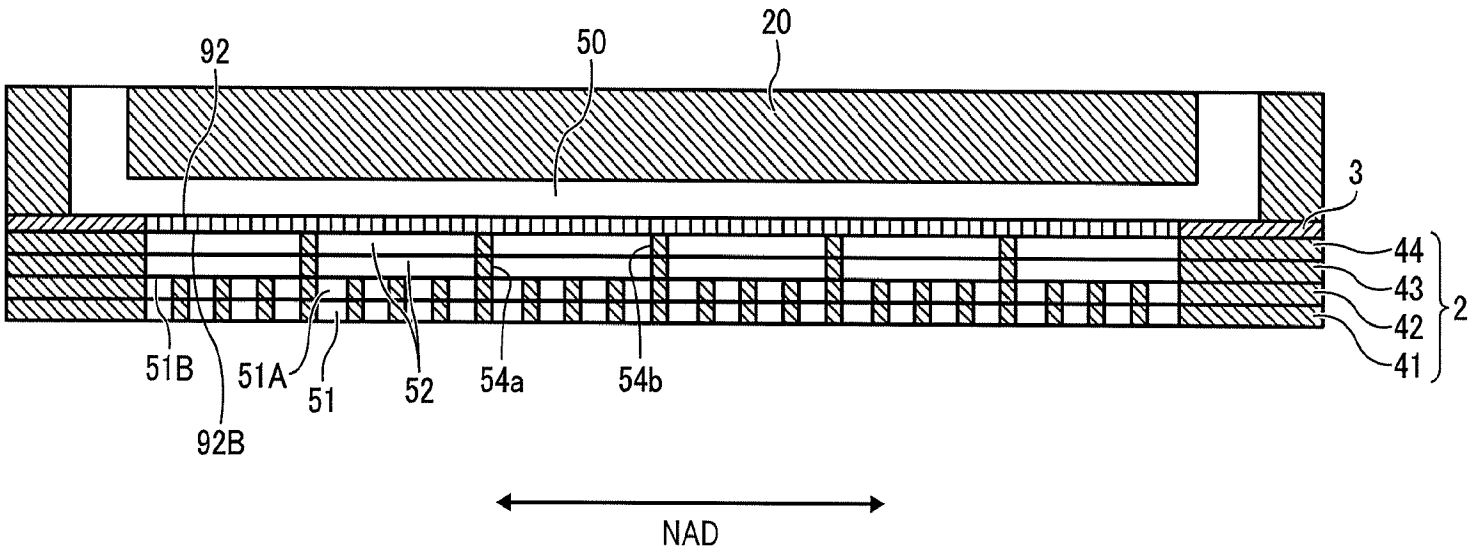
FIG. 5 is a cross-sectional view of a main portion of the liquid discharge head along line X-X of FIG. 4 along the nozzle array direction (NAD)

FIG. 5 is a cross-sectional view of a main portion of the head 1000 of FIG. 4 in a cross section A-A of FIG. 4 along the nozzle array direction.

FIGS. 6A through 6E are exploded plan views of the channel member 40.

In the present embodiment, as described above, the channel substrate 2 includes individual-drainage-channels 51 on a nozzle plate 1 side opposite the individual-liquid-chamber 6. The individual-drainage-channels 51 communicated with the individual-liquid-chambers 6 via the nozzle communication channel 5. The drainage-side common-liquid-chambers 50 communicate with each of the individual-drainage-channels 51.

A drainage-side filter 92 is disposed between the individual-drainage-channels 51 and the drainage-side common-liquid-chambers 50. The head 1000 includes the intermediate-drainage-channels 52 that face the drainage-side filter 92 and communicate with two or more (four in FIG. 5, for example) individual-drainage-channels 51 adjacent in the nozzle array direction (NAD) on an upstream side (on the individual-drainage-channel 51 side) of the drainage-side filter 92.

A cross-sectional area (cross-sectional area of opening) of the intermediate-drainage-channel 52 in a direction perpendicular to a direction of liquid flow is greater than a cross-sectional area (cross sectional area of opening) of the individual-drainage-channel 51 in the direction perpendicular to the direction of liquid flow.

In other words, a cross-sectional area of a boundary portion 92B between the intermediate-drainage-channel 52 and the drainage-side filter 92 is greater than a cross-sectional area of a boundary portion 51B between the individual-drainage-channel 51 and the intermediate-drainage-channel 52 as illustrated in FIGS. 4 and 5 and FIGS. 6A through 6E. This configuration can reduce variations in discharge characteristics such as discharge speed of the head 1000 when a direction of liquid flow is different between the intermediate-drainage-channel 52 and the individual-drainage-channel 51 or when cross-sectional areas of the intermediate-drainage-channel 52 and the individual-drainage-channel 51 vary according positions of the intermediate-drainage-channel 52 and the individual-drainage-channel 51.

In FIG. 5, positions of the boundary portion 51B and 92B are indicated at left end of the head 1000, however, the positions of the boundary portion 51B and 92B are not limited to the left end of the head 1000, and may be center or right end of the head 1000.

Further, the size relation of the cross-sectional areas between the boundary portion 92B and the boundary portion 51B described above may be applied to other individual-drainage-channels 51 and other drainage-side filters 92.

In the present embodiment, the channel substrate 2 is formed by laminating and bonding a plurality of plate members (thin-layer members) 41 to 44 from the nozzle plate 1 side. These plate members 41 to 44 and the diaphragm member 3 are laminated and bonded to form the channel member 40.

Figure 6A:
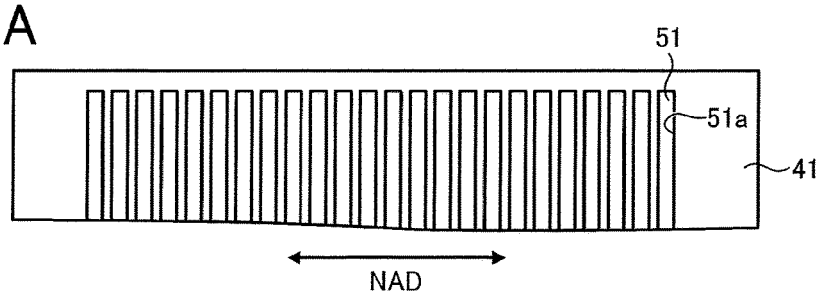
FIGS. 6A through 6E are exploded plan views of a main portion of a channel member.

As illustrated in FIG. 6A, the plate member 41 that forms the channel substrate 2 includes through-grooves 51*a* that constitute the individual-drainage-channels 51. The through-grooves are groove shaped through holes.

Figure 6B:
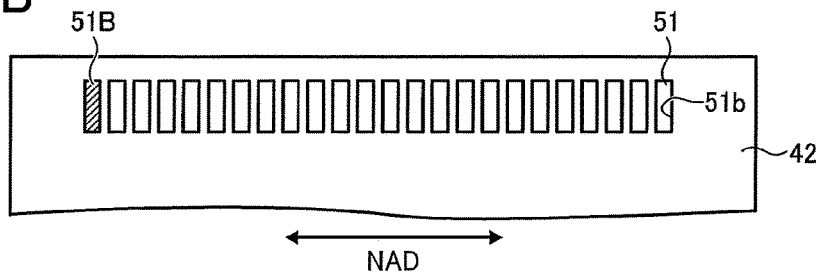

Similarly, as illustrated in FIG. 6B, the plate member 42 includes through-grooves 51*b* that constitute a part 51A (See FIGS. 4 and 5) of the individual-drainage-channel 51 while communicating with the through-grooves 51*a* of the plate member 41.

Figure 6C:
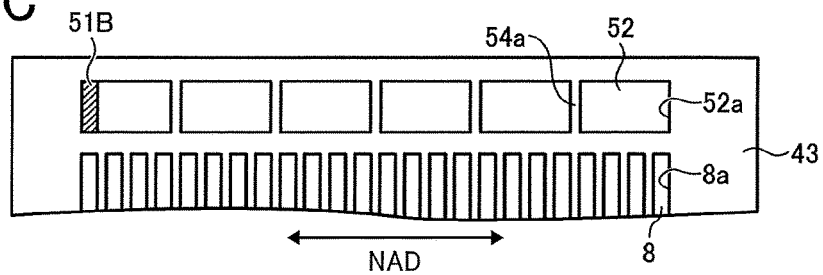

Similarly, as illustrated in FIG. 6C, the plate member 43 includes through-grooves 8*a* that constitute the individual-supply-channels 8 and through-grooves 52*a* that constitute the intermediate-drainage-channels 52. The through-grooves 52*a* corresponding to the adjacent intermediate-drainage-channels 52 are partitioned by the partition walls (third partition walls) 54*a*.

Figure 6D:
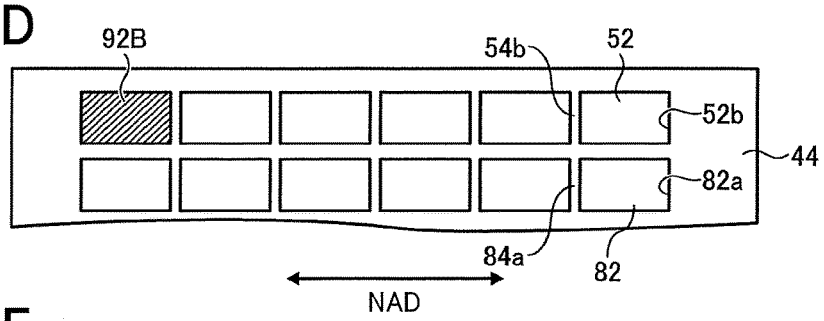

Similarly, as illustrated in FIG. 6D, the plate member 44 includes through-grooves 82*a* that constitute the intermediate-supply-channels 82 and through-grooves 52*a* that constitute the intermediate-drainage-channels 52. The through-grooves 82*a* corresponding to the adjacent intermediate-supply-channels 82 are partitioned by the partition walls (fourth partition walls) 84*a*. The through-groove portions 52*b* corresponding to the adjacent intermediate-drainage-channels 52 are partitioned by the partition walls 54*b*.

Figure 6E:
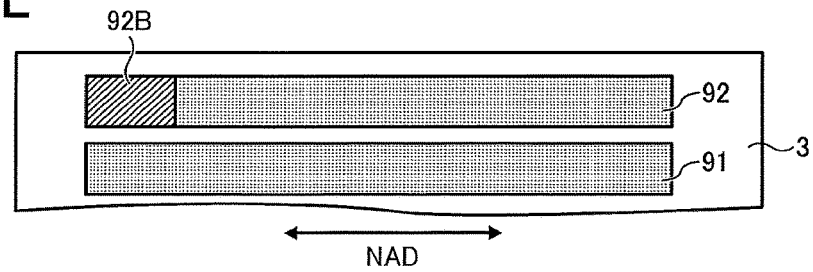

As illustrated in FIG. 6E, the diaphragm member 3 is provided with the drainage-side filter 92 and the supply-side filter 91. As illustrated in FIGS. 4 and 5, the drainage-side filter 92 is interposed between the intermediate-drainage-channel 52 and the drainage-side common-liquid-chamber 50. The supply-side filter 91 is interposed between the intermediate-supply-channel 82 and the supply-side common-liquid-chamber 10.

As described above, the head 1000 can prevent foreign substances from entering the individual-drainage-channels 51 from the drainage-side common-liquid-chamber 50 when assembling the head 1000 since the drainage-side filter 92 is disposed between the intermediate-drainage-channels 52 (and the individual-drainage-channels 51) and the drainage-side common-liquid-chamber 50. Therefore, the present embodiment can prevent foreign substances from getting inside the head 1000.

Liquid flows from the individual-drainage-channel 51 to the drainage-side common-liquid-chamber 50. Thus, it is not necessary to provide the filter between the individual-drainage-channel 51 and the drainage-side common-liquid-chamber 50 for the purpose of removing the foreign substance in liquid. However, in the present embodiment, the drainage-side filter 92 is provided for preventing foreign substances from entering into the individual-drainage-channel 51 from the drainage-side common-liquid-chamber 50 when assembling the head 1000, for example.

Providing the drainage-side filter 92 between the individual-drainage-channels 51 and the drainage-side common-liquid-chamber 50 can prevent foreign substances from flowing into the individual-drainage-channels 51 from the drainage-side common-liquid-chamber 50 when the liquid flows backward from the drainage-side common-liquid-chamber 50 to the individual-drainage-channels 51.

Both diameters of filter holes 91*a* of the supply-side filter 91 and diameters of filter holes 92*a* of the drainage-side filter 92 are smaller than the diameter of the nozzles 4. Thus, the supply-side filter 91 and the drainage-side filter 92 can remove foreign substances that may clog in the nozzles 4.

An area of the drainage-side filter 92 connected to one individual-drainage-channel 51 increases since the head 1000 includes the intermediate-drainage-channel 52 communicating with two or more individual-drainage-channels 51 adjacent on an upstream side of the drainage-side filter 92.

Therefore, even if the bubbles from the individual-drainage-channels 51 are retained by the drainage-side filter 92, a ratio of an area covered with the bubbles to an area of the drainage-side filter 92 corresponding to the intermediate-drainage-channel 52 decreases. Thus, the present embodiment can reduce the impact of bubbles trapped (retained) at the drainage-side filter 92 and provide more stable discharge characteristics.

If the individual-drainage-channel 51 directly faces and connects the drainage-side filter 92, an area of the drainage-side filter 92 corresponding to one individual-drainage-channel 51 is only the size of an area for one individual-drainage-channel 51. Therefore, if bubbles are trapped and retained by the drainage-side filter 92, most of an area of the drainage-side filter 92 corresponding to this individual-drainage-channel 51 is covered by the retained bubbles.

As a result, fluid resistance of the individual-drainage-channel 51 increases. Further, a meniscus pressure in the nozzle 4 increases that causes an increase in discharge amount. A difference in retention amount of bubbles in each individual-drainage-channels 51 occurs. This difference in retention amount of bubbles causes a variation in the meniscus pressure in the nozzle 4 and thus a variation in discharge characteristics of the head 1000.

On the other hand, the present embodiment includes the intermedi ate-drainage-channel 52 communicating with two or more individual-drainage-channels 51 between the individual-drainage-channels 51 and the drainage-side filter 92. Thereby, an area of the drainage-side filter 92 corresponding to one individual-drainage-channel 51 is increased. Thus, the influence of the bubble retention is dispersed and reduced, and the variation in the discharge characteristics of the head 1000 is reduced.

Further, the present embodiment includes a plurality of intermediate-drainage-channels 52 corresponding to two or more individual-drainage-channels 51 but fewer than all individual-drainage-channels 51. In other words, the present embodiment does not let all the individual-drainage-channels 51 correspond to (communicate with) one intermediate-drainage-channel 52.

As a result, a velocity of the liquid flowing into the drainage-side filter 92 from the individual-drainage-channels 51 in the present embodiment becomes higher than a velocity in a configuration in which one intermediate-drainage-channel 52 corresponds to all the individual-drainage-channels 51. Thus, bubbles easily pass through the drainage-side filter 92, and the ability to expel bubbles is improved.

A second embodiment of the head 1000 according to the present disclosure is described with reference to FIGS. 7 and 8.

Figure 7:
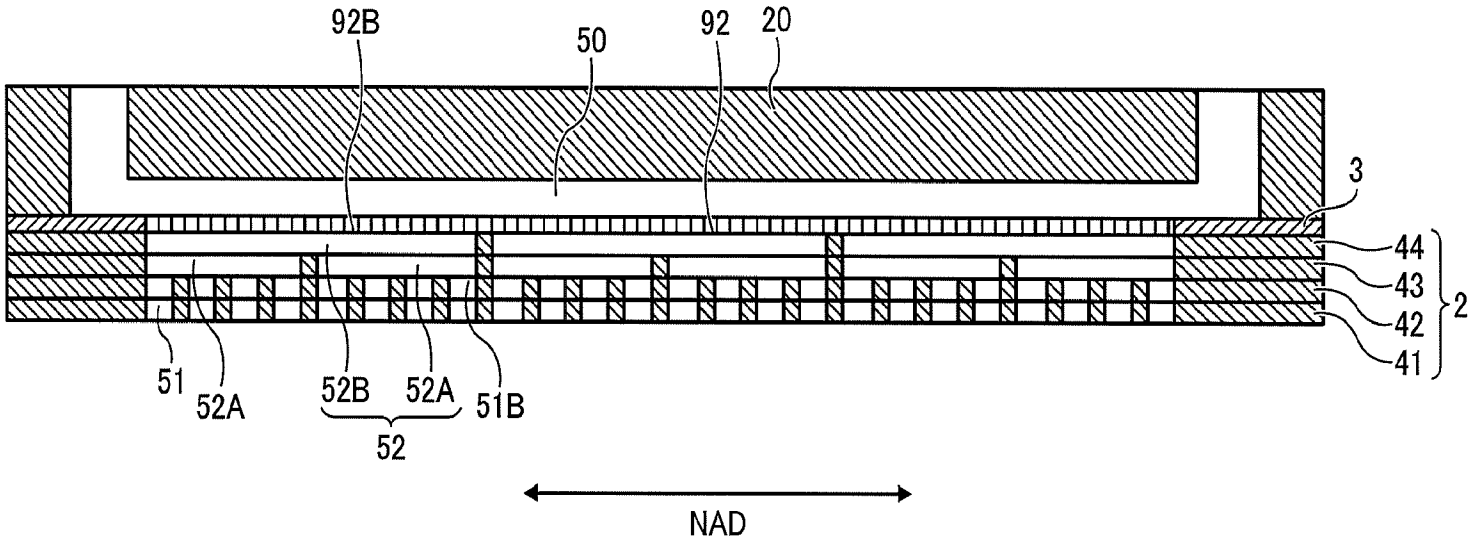
FIG. 7 is a cross-sectional view of a main portion of the liquid discharge head along the nozzle array direction (NAD) in a second embodiment of the present disclosure.

FIG. 7 is a cross-sectional view of a main portion of the head 1000 in the nozzle array direction (NAD).

Figure 8A:
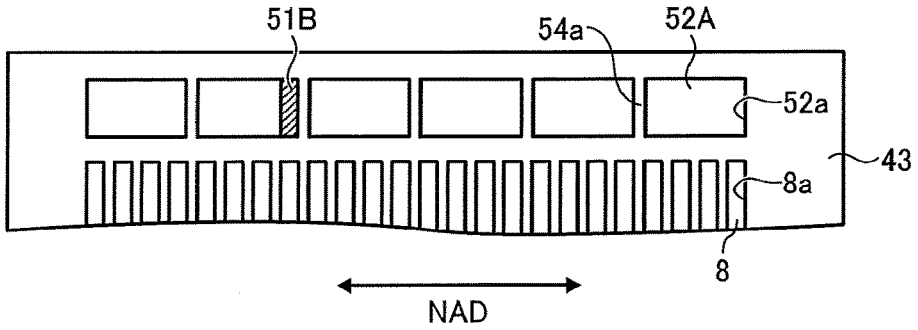
FIGS. 8A and 8B are exploded plan views of plate members that form an intermediate-drainage-channel.
Figure 8B:
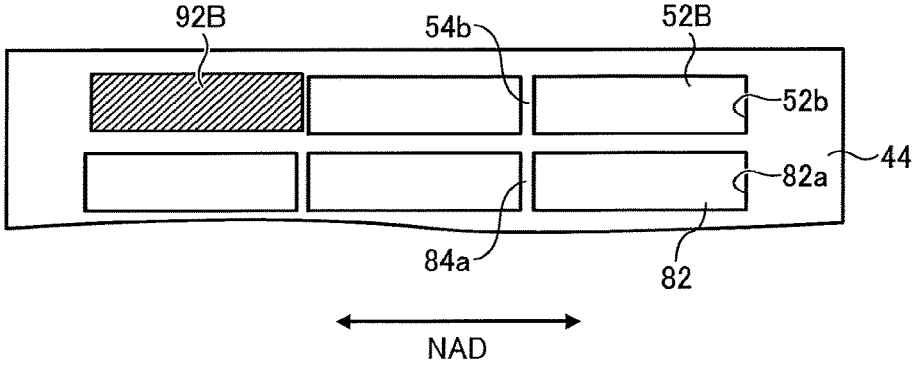

FIGS. 8A and 8B are exploded plan views of plate members 43 and 44 that form the intermediate-drainage-channel 52.

In the present embodiment, the intermediate-drainage-channel 52 includes an upstream-side intermediate-drainage-channel 52A and a downstream-side intermediate-drainage-channel 52B. The upstream-side intermediate-drainage-channel 52A communicates with two or more adjacent individual-drainage-channels 51. The downstream-side intermediate-drainage-channel 52B communicates with two or more adjacent upstream-side intermediate-drainage-channels 52A.

As described above, the present embodiment can suppress a decrease in a flow rate and improve bubble the ability to expel by gradually enlarging an area of the intermediate-drainage-channel 52 even if the intermediate-drainage-channel 52 having a large cross-sectional area as defined by the intermediate-drainage-channel 52B is provided in order to further suppress the influence of retained bubbles.

A third embodiment of the head 1000 according to the present disclosure is described with reference to FIGS. 9 and FIG. 10A and 10B.

Figure 9:
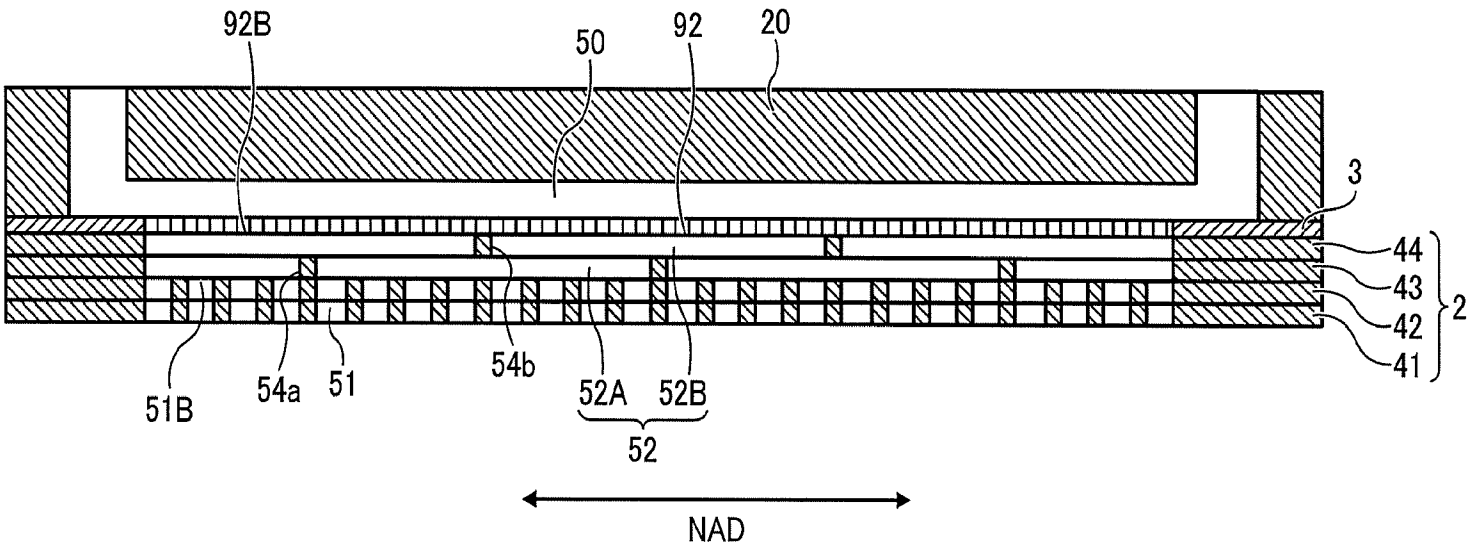
FIG. 9 is a cross-sectional view of a main portion of the liquid discharge head along the nozzle array direction (NAD) in a third embodiment of the present disclosure.

FIG. 9 is a cross-sectional view of a main portion of the head 1000 in the nozzle array direction (NAD).

Figure 10A:
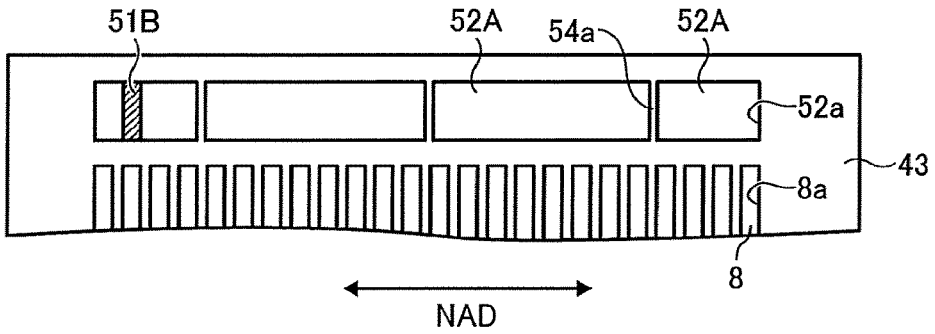
FIGS. 10A and 10B are exploded plan views of plate members that form an intermediate-drainage-channel.
Figure 10B:
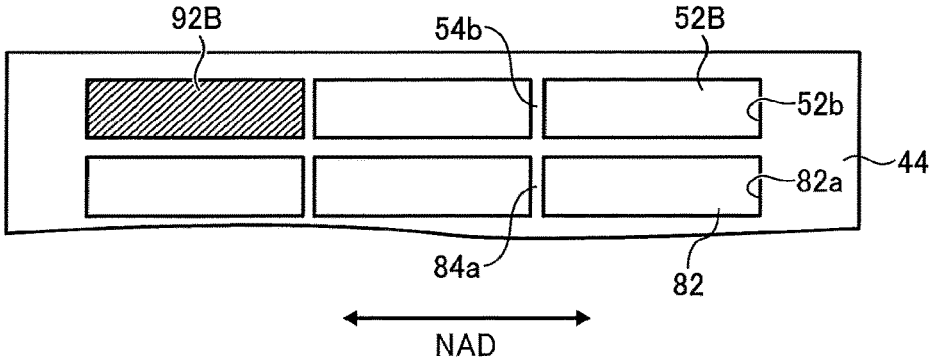

FIGS. 10A and 10B are exploded plan views of plate members 43 and 44 that form the intermediate-drainage-channel 52

In the present embodiment, as similar to the second embodiment, the intermediate-drainage-channel 52 includes an upstream-side intermediate-drainage-channel 52A and a downstream-side intermediate-drainage-channel 52B. The upstream-side intermediate-drainage-channels 52A communicate with two or more adjacent individual-drainage-channels 51.

The downstream-side intermediate-drainage-channels 52B communicate with two or more adjacent upstream-side intermediate-drainage-channels 52A.

The partition walls (first partition wall) 54*a* that partition the upstream-side intermediate-drainage-channels 52A and the partition walls (second partition wall) 54*b* that partition the downstream-side intermediate-drainage-channel 52B are offset in the nozzle array direction (NAD).

As a result, all the intermediate-drainage-channels 52A and 52B communicates in the nozzle array direction (NAD). Therefore, the present embodiment can further disperse the influence of retained bubbles and reduce variations in discharge characteristics.

Partitioning the intermediate-drainage-channel 52B opposed to the drainage-side filter 92 in the present embodiment can maintain good flow rate and improve the ability to expel bubbles compared with a configuration in which all the individual-drainage-channels 51 is corresponded to just one intermediate-drainage-channel 52 without a partition. Furthermore, since the partition walls 54*a* and 54*b* are arranged in a staggered manner in the nozzle array direction (NAD), the rigidity of the plate members 43 and 44 can also be maintained.

A fourth embodiment according to the present disclosure is described with reference to FIG. 11.

Figure 11:
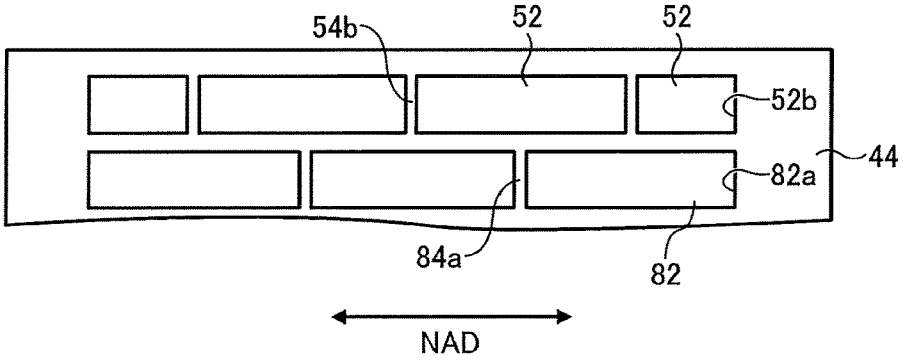
FIG. 11 is a plan view of a plate member forming an intermediate-drainage-channel and an intermediate-supply-channel in a fourth embodiment of the present disclosure.

FIG. 11 is a plan view of a plate member 44 forming the intermediate-drainage-channel 52 and the intermediate-supply-channel in the present embodiment.

In the present embodiment, the partition walls 54*b* of the intermediate-drainage-channels 52 and the partition walls

84*a* of the intermediate-supply-channel 82 are alternately provided in the nozzle array direction NAD as illustrated in FIG. 11.

Accordingly, a sufficient rigidity of the plate members 43 and 44 can be obtained.

A fifth embodiment according to the present disclosure is described with reference to FIG. 12.

Figure 12:
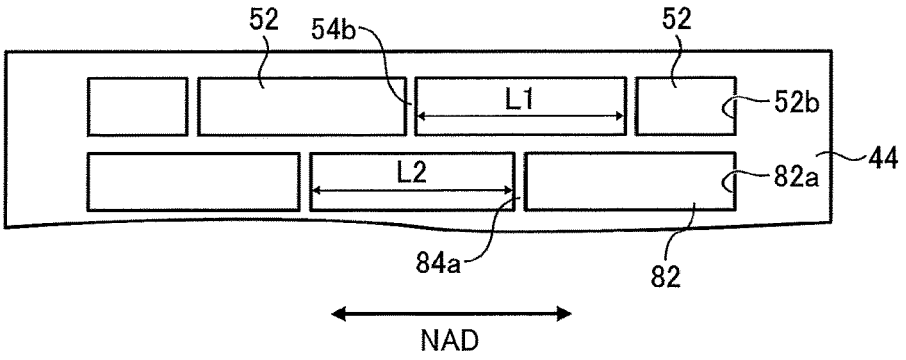
FIG. 12 is a plan view of a plate member forming an intermediate-drainage-channel and an intermediate-supply-channel in a fifth embodiment of the present disclosure.

FIG. 12 is a plan view of a plate member 44 forming the intermediate-drainage-channel 52 and the intermediate-supply-channel in the present embodiment.

In the present embodiment, as illustrated in FIG. 12, an interval L1 between the partition walls 54*b* of the intermediate-drainage-channel 52 and an interval L2 between the partition walls 84*a* of the intermediate-supply-channel 82 are substantially identical.

Thereby, the rigidity of the plate members 44 can be made uniform between the plate members 44, and strengths of the plate members 44 can thus be secured.

In each of the above-described embodiments, a configuration having an intermediate-supply-channel 82 is described, but it is also possible to adopt a configuration in which the individual-supply-channel 8 directly communicates with the supply-side common-liquid-chamber 10.

Figure 13:
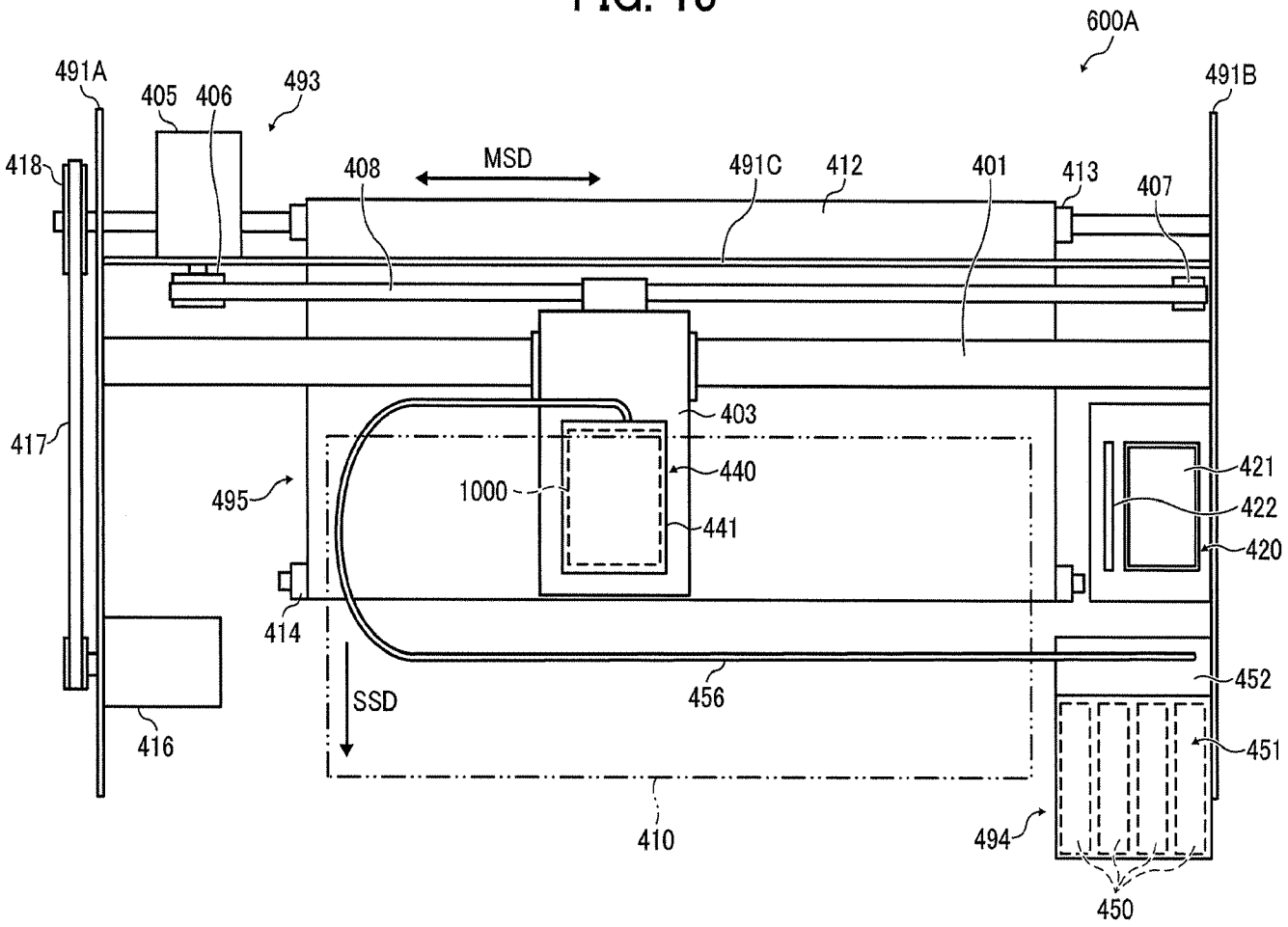
FIG. 13 is a plan view of a main portion of an example of a liquid discharge apparatus according to an embodiment of the present disclosure.
Figure 14:
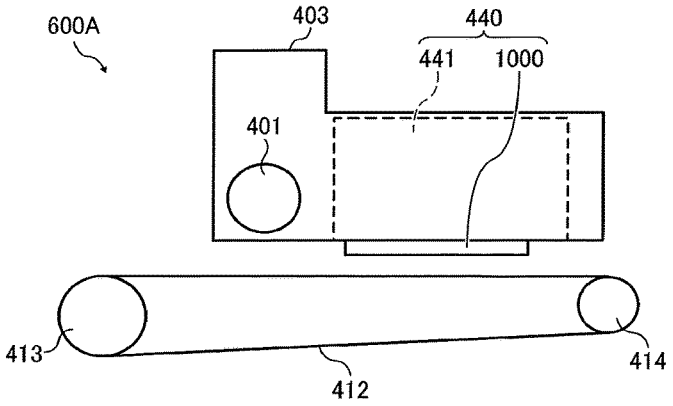
FIG. 14 is a side view of a main portion of the liquid discharge apparatus.

FIGS. 13 and 14 illustrate an example of a liquid discharge apparatus 600A according to the present disclosure.

FIG. 13 is a plan view of a main part of the liquid discharge apparatus 600A.

FIG. 14 is a side view of a main part of the liquid discharge apparatus 600A.

The liquid discharge apparatus 600A is a serial-type apparatus in which a main scan moving unit 493 reciprocally moves a carriage 403 in a main scanning direction indicated by arrow MSD in FIG. 13. The main scan moving unit 493 includes a guide 401, a main scanning motor 405, a timing belt 408, etc. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The timing belt 408, the drive pulley 406, and the driven pulley 407 serves as a drive unit to move the carriage 403 in a main scanning direction (MSD).

The carriage 403 mounts a liquid discharge device 440 in which the head 1000 according to the present disclosure and a head tank 441 are integrated as a single unit. The head 1000 of the liquid discharging device 440 discharges color liquids of, for example, yellow (Y), cyan (C), magenta (M), and black (K). The head 1000 includes nozzle arrays, each including a plurality of nozzles 4 arrayed in row in a sub-scanning direction indicated by arrow SSD in FIGS. 13 and 14.

The sub-scanning direction (SSD) is perpendicular to the main scanning direction MSD. The head 1000 is mounted to the carriage 403 so that ink droplets are discharged downward.

The liquid stored outside the head 1000 is supplied to the head 1000 via a supply unit 494 that supplies the liquid from a liquid cartridge 450 to the head tank 441.

The supply unit 494 includes, e.g., a cartridge holder 451 as a mount part to mount a liquid cartridge 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridge 450.

The liquid discharge apparatus 600A includes a conveyance unit 495 to convey a sheet 410. The conveyance unit 495 includes a conveyance belt 412 as a conveyor and a sub-scanning motor 416 to drive the conveyance belt 412.

The conveyance belt 412 attracts the sheet 410 and conveys the sheet 410 at a position facing the head 1000. The conveyance belt 412 is in the form of an endless belt. The conveyance belt 412 is stretched between a conveyance roller 413 and a tension roller 414. The sheet 410 is attracted to the conveyance belt 412 by electrostatic force or air suction.

The conveyance roller 413 is rotated by a sub-scanning motor 416 via a timing belt 417 and a timing pulley 418, so that the conveyance belt 412 circulates in a sub-scanning direction indicated by arrow SSD in FIGS. 13 and 14.

At one side in the main scanning direction MSD of the carriage 403, a maintenance unit 420 to recover the head 1000 in good condition is disposed on a lateral side (right-hand side) of the conveyance belt 412 in FIG. 13.

The maintenance unit 420 includes, for example, a cap 421 to cap the nozzle face (i.e., a face on which the nozzles are formed) of the head 1000 and a wiper 422 to wipe the nozzle face.

The main scan moving unit 493, the supply unit 494, the maintenance unit 420, and the conveyance unit 495 are mounted to a housing 491 that includes the left side plate 491A, the right side plate 491B, and a rear side plate 491C.

In the liquid discharge apparatus 600A thus configured, a sheet 410 is conveyed on and attracted to the conveyance belt 412 and is conveyed in the sub-scanning direction SSD by the cyclic rotation of the conveyance belt 412.

The head 1000 is driven in response to image signals while the carriage 403 moves in the main scanning direction MSD, to discharge liquid to the sheet 410 stopped, thus forming an image on the sheet 410.

As described above, the liquid discharge apparatus 600A includes the head 1000 according to the present disclosure, thus allowing stable formation of high quality images.

Figure 15:
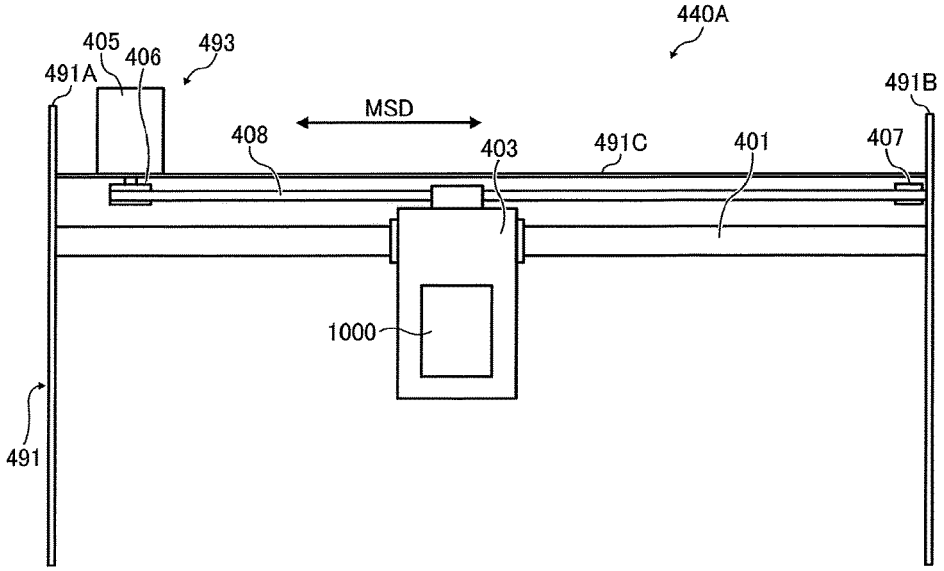
FIG. 15 is a plan view of an example of a main portion of a liquid discharge device according to the present disclosure.

FIG. 15 illustrates another example of the liquid discharge device 440A according to another embodiment of the present disclosure.

FIG. 15 is a plan view of a main part of the liquid discharge device 440A.

The liquid discharge device 440A includes the housing 491, the main scan moving unit 493, the carriage 403, and the head 1000 among components of the liquid discharge apparatus 600A. The left side plate 491A, the right side plate 491B, and the rear side plate 491C constitute the housing 491.

Note that, in the liquid discharge device 440A, at least one of the maintenance unit 420 and the supply unit 494 described above may be mounted on, for example, the right side plate 491B.

Figure 16:
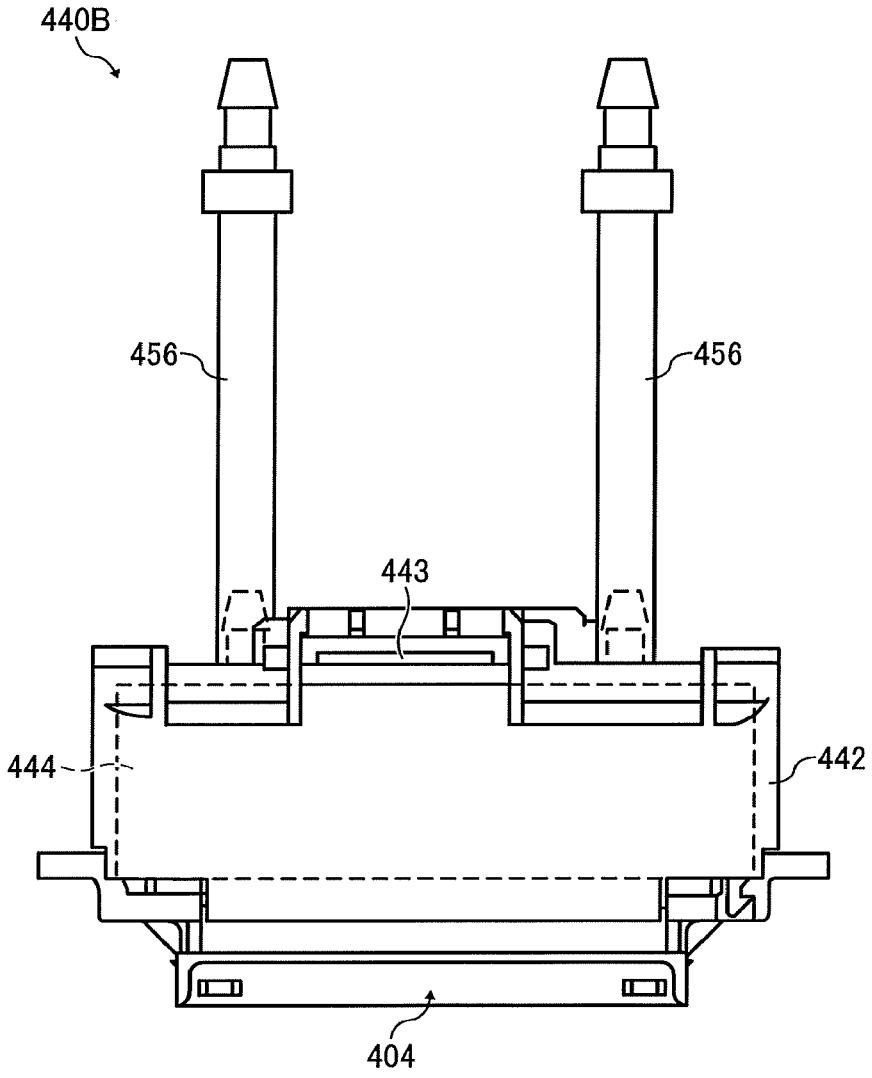
FIG. 16 is a front view of another example of a liquid discharge device.

FIG. 16 illustrates still another example of the liquid discharge device 440B according to the present disclosure.

FIG. 16 is a front view of the liquid discharge device 440B.

The liquid discharge device 440B includes the head 1000 to which a channel part 444 is mounted and a tube 456 connected to the channel part 444. The channel part 444 serves as the liquid supply member.

Further, the channel part 444 is disposed inside a cover 442. Instead of the channel part 444, the liquid discharge device 440B may include the head tank 441. A connector 443 to electrically connect the head 1000 to a power source is disposed above the channel part 444.

Figure 17:
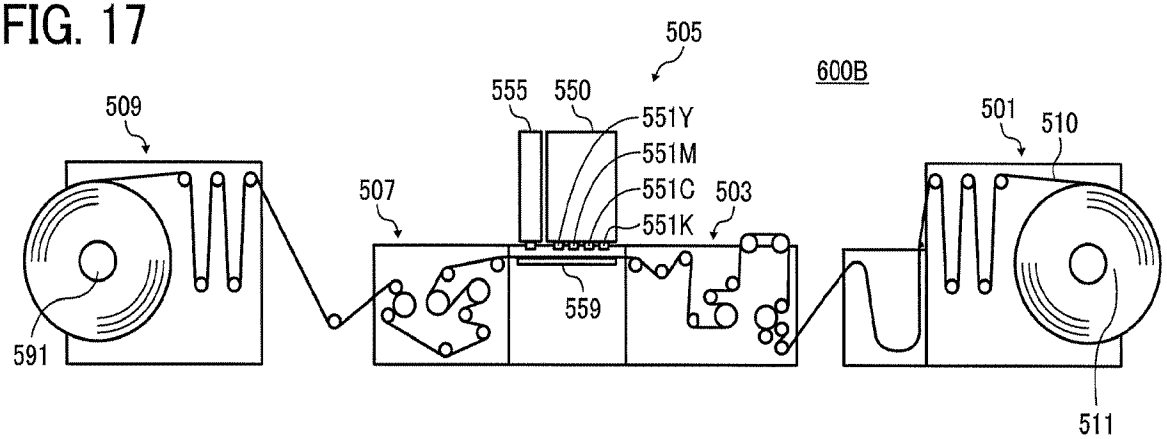
FIG. 17 is a front view a liquid discharge apparatus according to still another embodiment of the present disclosure.
Figure 18:
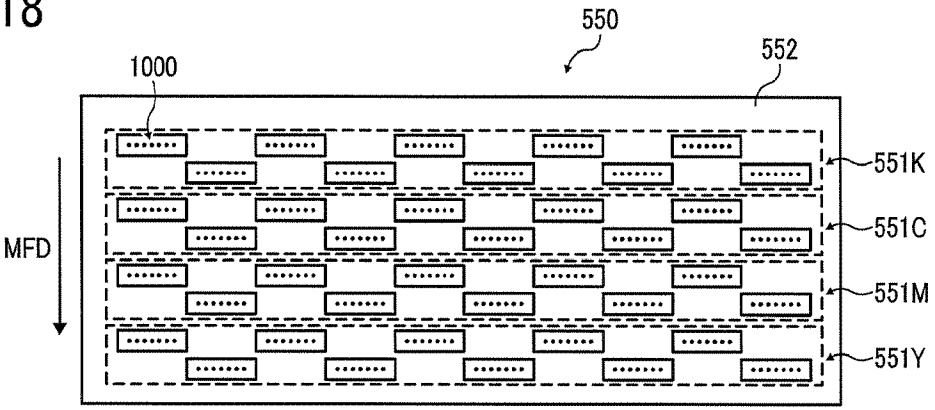
FIG. 18 is a plan view of a head unit of the liquid discharge apparatus of FIG. 17 according to an embodiment of the present disclosure.

FIGS. 17 and 18 illustrate an example of a liquid discharge apparatus 600B according to the present disclosure.

FIG. 17 is a schematic front view of the liquid discharge apparatus 600B.

FIG. 18 is a plan view of a first head unit 550 of the liquid discharge apparatus 600B of FIG. 17.

The liquid discharge apparatus 600B according to the present disclosure includes a feeder 501 to feed a medium 510, a guide conveyor 503 to guide and convey the medium 510, fed from the feeder 501, to a printing unit 505, the printing unit 505 to discharge liquid onto the medium 510 to form an image on the medium 510, a drier unit 507 to dry the medium 510, and an ejector 509 to eject the medium 510. The medium 510 is a continuous medium such as a rolled sheet.

The medium 510 is fed from a root winding roller 511 of the feeder 501, guided and conveyed with rollers of the feeder 501, the guide conveyor 503, the drier unit 507, and the ejector 509, and wound around a take-up roller 591 of the ejector 509.

In the printing unit 505, the medium 510 is conveyed opposite a first head unit 550 and a second head unit 555 on a conveyance guide 559. The first head unit 550 discharges liquid to form an image on the medium 510. Post-treatment is performed on the medium 510 with treatment liquid discharged from the second head unit 555.

Here, the first head unit 550 includes, for example, four-color full-line head arrays 551K, 551C, 551M, and 551Y (hereinafter, collectively referred to as "head arrays 551" unless colors are distinguished) from an upstream side in a feed direction of the medium 510 (hereinafter, "medium feed direction") indicated by arrow MFD in FIG. 18.

The head arrays 551K, 551C, 551M, and 551Y are liquid dischargers to discharge liquid of black (K), cyan (C), magenta (M), and yellow (Y) onto the medium 510. Note that the number and types of color are not limited to the above-described four colors of K, C, M, and Y and may be any other suitable number and types.

In each head arrays 551, for example, as illustrated in FIG. 18, a plurality of discharge heads (also referred to as simply "heads") 1000 are staggered on a base 552 to form the head arrays 551. Note that the configuration of the head arrays 551 is not limited to such a configuration.

Next, an example of a liquid circulation system according to an embodiment of the present disclosure is described with reference to FIG. 19.

Figure 19:
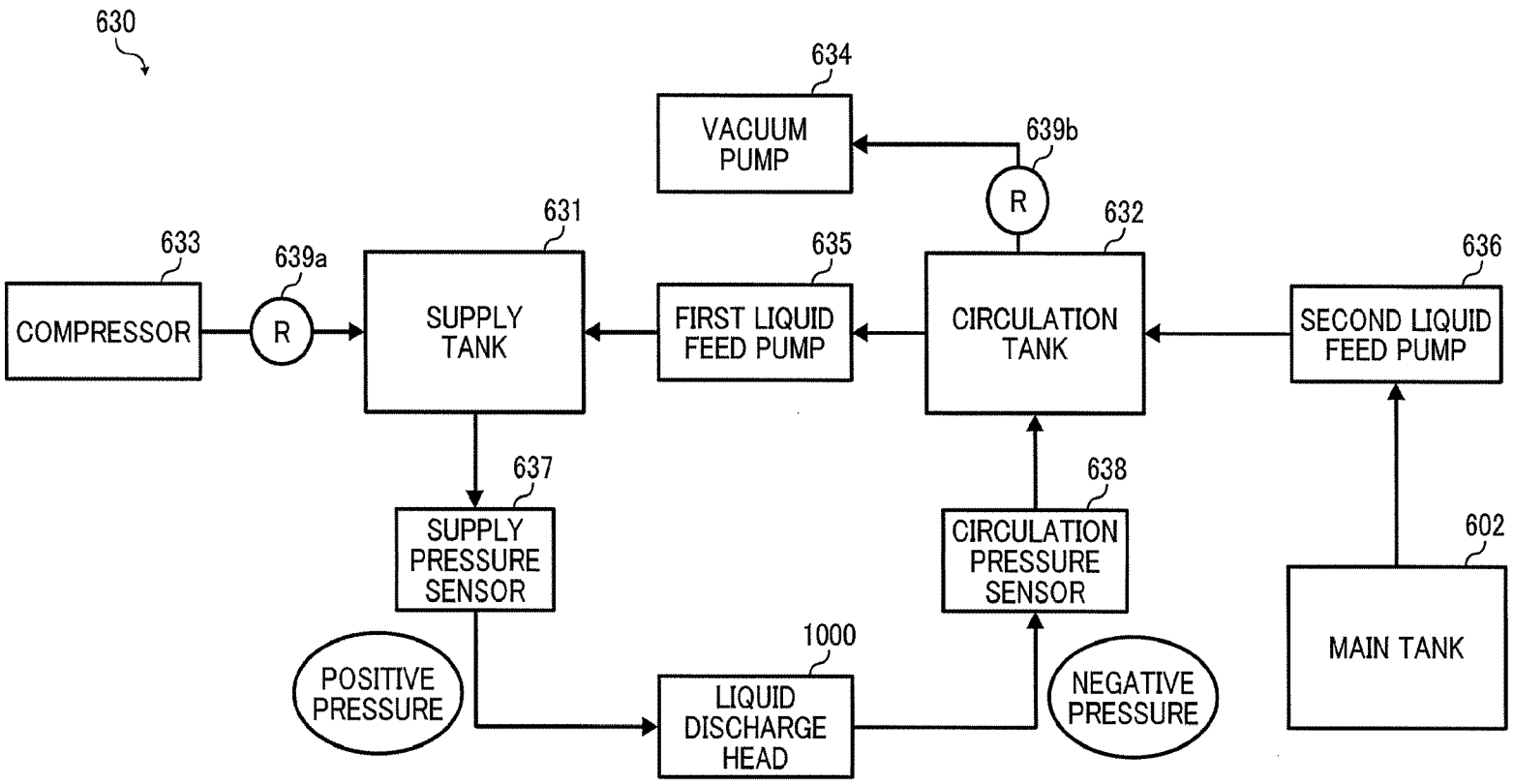
FIG. 19 is a block diagram of a liquid circulation system of the liquid discharge apparatus of FIG. 17 according to the embodiment of the present disclosure.

FIG. 19 is a block diagram of the liquid circulation system according to an embodiment of the present disclosure.

As illustrated in FIG. 19, the liquid circulation system 630 includes a main tank 602, the heads 1000, a supply tank 631, a circulation tank 632, a compressor 633, a vacuum pump 634, a first liquid feed pump 635, a second liquid feed pump 636, a regulator (R) 639*a* and 639*b*, a supply pressure sensor 637 on the supply side, and a circulation pressure sensor 638 on the circulation side.

The supply pressure sensor 637 is disposed between the supply tank 631 and the heads 1000 and connected to a supply channel connected to the supply ports 71 (see FIG. 1) of the heads 1000. The circulation pressure sensor 638 is disposed between the circulation tank 632 and the heads 1000 and connected to a supply channel connected to the drainage ports 72 (see FIG. 1) of the heads 1000.

One end of the circulation tank 632 is connected with the supply tank 631 via the first liquid feed pump 635 and the other end of the circulation tank 632 is connected with the main tank 602 via the second liquid feed pump 636.

Thus, liquid is supplied from the supply tank 631 into the heads 1000 through the supply ports 71 and output from the drainage ports 72 to the circulation tank 632. Further, the first liquid feed pump 635 feeds liquid from the circulation tank 632 to the supply tank 631, thus circulating liquid.

The supply tank 631 is connected to the compressor 633 and controlled so that a predetermined positive pressure is detected with the supply pressure sensor 637. The circulation tank 632 is connected to the vacuum pump 634 and controlled so that a predetermined negative pressure is detected with the circulation pressure sensor 638.

Such a configuration allows the menisci of ink to be maintained at a constant negative pressure while circulating ink through the inside of the heads 1000.

When droplets are discharged from the nozzles 4 of the heads 1000, the amount of liquid in each of the supply tank 631 and the circulation tank 632 decreases. Hence, the second liquid feed pump 636 replenishes liquid from the main tank 602 to the circulation tank 632. The replenishment timing of liquid from the main tank 602 to the circulation tank 632 is controlled in accordance with a result of detection with, e.g., a liquid level sensor in the circulation tank 632, for example, in a manner in which liquid is replenished when the liquid level of liquid in the circulation tank 632 is lower than a predetermined height.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling.

Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

"The liquid discharge device" is an integrated unit including the head and a functional part(s) or unit(s), and is an assembly of parts relating to liquid discharge. For example, "the liquid discharge device" may be a combination of the head with at least one of a head tank, a carriage, a supply unit, a maintenance unit, and a main scan moving unit.

Herein, the terms "integrated" or "united" mean fixing the head and the functional parts (or mechanism) to each other by fastening, screwing, binding, or engaging and holding one of the head and the functional parts movably relative to the other. The head may be detachably attached to the functional part(s) or unit(s) each other.

For example, the head and a head tank are integrated as the liquid discharge device. The head and the head tank may be connected each other via, e.g., a tube to integrally form the liquid discharge device. Here, a unit including a filter may further be added to a portion between the head tank and the head.

The liquid discharge device may be an integrated unit in which a head is integrated with a carriage.

The liquid discharge device may be the head movably held by a guide that forms part of a main scan moving unit, so that the head and the main scan moving unit are integrated as a single unit. The liquid discharge device may include the head, the carriage, and the main scan moving unit that are integrated as a single unit.

In another example, the cap that forms part of the maintenance unit is secured to the carriage mounting the head so that the head, the carriage, and the maintenance unit are integrated as a single unit to form the liquid discharge device.

Further, the liquid discharge device may include tubes connected to the head mounted on the head tank or the channel member so that the head and the supply unit are integrated as a single unit. Liquid is supplied from a liquid reservoir source such as liquid cartridge to the head through the tube.

The main scan moving unit may be a guide only. The supply unit may be a tube(s) only or a mount part (loading unit) only.

The term "liquid discharge apparatus" used herein also represents an apparatus including the head or the liquid discharge device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, on which the liquid has been discharged.

The "liquid discharge apparatus" may be, for example, an image forming apparatus to form an image on a sheet by discharging ink, or a three-dimensional fabricating apparatus to discharge a fabrication liquid to a powder layer in which powder material is formed in layers, so as to form a three-dimensional fabrication object.

In addition, "the liquid discharge apparatus" is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate.

Examples of the "medium on which liquid can be adhered" include recording media, such as paper sheet, recording paper, recording sheet of paper, film, and cloth, electronic component, such as electronic substrate and piezoelectric element, and media, such as powder layer, organ model, and testing cell.

The "medium on which liquid can be adhered" includes any medium on which liquid is adhered, unless particularly limited.

Examples of "the material on which liquid can be adhered" include any materials on which liquid can be adhered even temporarily, such as paper, thread, fiber, fabric, leather, metal, plastic, glass, wood, and ceramic.

"The liquid discharge apparatus" may be an apparatus to relatively move a head and a medium on which liquid can be adhered. However, the liquid discharge apparatus is not limited to such an apparatus. For example, the liquid discharge apparatus may be a serial head apparatus that moves the head or a line head apparatus that does not move the head.

Examples of "the liquid discharge apparatus" further include a treatment liquid coating apparatus to discharge a treatment liquid to a sheet surface to coat the sheet surface with the treatment liquid to reform the sheet surface and an injection granulation apparatus to eject a composition liquid including a raw material dispersed in a solution from a nozzle to mold particles of the raw material.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a plurality of nozzles from which liquid is discharged;

a plurality of individual-liquid-chambers communicating with the plurality of nozzles, respectively;

a plurality of individual-drainage-channels communicating with the plurality of individual-liquid-chambers, respectively;

a drainage-side common-liquid-chamber communicating with each of the plurality of individual-drainage-channels;

a filter having filter holes and disposed between the plurality of individual-drainage-channels and the drainage-side common-liquid-chamber; and an intermediate-drainage-channel disposed between the filter and the plurality of individual-drainage-channels, the intermediate-drainage-channel facing the filter and communicating with two or more of the plurality of individual-drainage-channels, a cross-sectional area of the intermediate-drainage-channel being greater than a cross-sectional area of each of the plurality of individual-drainage-channels communicating with the intermediate-drainage-channel in a direction perpendicular to a direction of liquid flow.

2. The liquid discharge head according to claim 1, wherein the intermediate-drainage-channel includes upstream-side intermediate-drainage-channels and a downstream-side intermediate-drainage-channel, and the downstream-side intermediate-drainage-channel communicates with two or more of the upstream-side intermediate-drainage-channels.

3. The liquid discharge head according to claim 1, wherein the intermediate-drainage-channel includes upstream-side intermediate-drainage-channels and downstream-side intermediate-drainage-channels;

the upstream-side intermediate-drainage-channels include a first partition wall that partitions adjacent two of the upstream-side intermediate-drainage-channels;

the downstream-side intermediate-drainage-channels include a second partition wall that partitions adjacent two of the downstream-side intermediate-drainage-channels; and the first partition wall and the second partition wall are offset in a nozzle array direction along which the plurality of nozzles is arrayed.

4. The liquid discharge head according to claim 1, further comprising:

a supply-side common-liquid-chamber to supply liquid to the plurality of individual-liquid-chambers;

a plurality of intermediate-supply-channels disposed between the supply-side common-liquid-chamber and the plurality of individual-liquid-chambers, the plurality of intermediate-supply-channels communicating with two or more of the plurality of individual-liquid-chambers; and a plate member forming a plurality of intermediate-drainage-channels, each having a same configuration as the intermediate-drainage-channel, and the plurality of intermediate-supply-channels, wherein a first partition wall that partitions adjacent two of the plurality of intermediate-drainage-channels and a second partition wall that partitions adjacent two of the plurality of intermediate-supply-channels are offset in a nozzle array direction along which the plurality of nozzles is arrayed.

5. The liquid discharge head according to claim 4, wherein an interval between third partition walls of the plurality of intermediate-drainage-channels and an interval between fourth partition walls of the plurality of intermediate-supply-channels are identical.

6. The liquid discharge head according to claim 1, further comprising a diaphragm member forming a wall of the plurality of individual-liquid-chambers, wherein the filter is provided on the diaphragm member.

7. The liquid discharge head according to claim 1, wherein a diameter of the filter holes of the filter is smaller than a diameter of the nozzles.

8. A liquid discharge device comprising the liquid discharge head according to claim 1.

9. The liquid discharge device according to claim 8, further comprising at least one of:

a head tank to store the liquid to be supplied to the liquid discharge head;

a carriage to mount the liquid discharge head;

a supply unit to supply the liquid to the liquid discharge head;

a maintenance unit to maintain the liquid discharge head; and a drive unit to move the carriage in a main scanning direction, to be integrated with the liquid discharge head as a single unit.

10. A liquid discharge apparatus comprising the liquid discharge device according to claim 8.

11. A liquid discharge head comprising:

a plurality of nozzles from which liquid is discharged:

a plurality of individual-liquid-chambers communicating with the plurality of nozzles, respectively;

a plurality of individual-drainage-channels communicating with the plurality of individual-liquid-chambers, respectively;

a drainage-side common-liquid-chamber communicating with each of the plurality of individual-drainage-channels;

a filter disposed between the plurality of individual-drainage-channels and the drainage-side common-liquid-chamber; and an intermediate-drainage-channel disposed between the filter and the plurality of individual-drainage-channels, the intermediate-drainage-channel facing the filter and communicating with two or more of the plurality of individual-drainage-channels, a cross-sectional area of a boundary portion between the intermediate-drainage-channel and the filter being greater than a cross-sectional area of a boundary portion between the intermediate-drainage-channel and each of the plurality of the individual-drainage-channels communicating with the intermediate-drainage-channel.

* * * * *